US007681582B2

(12) United States Patent
Wetzel et al.

(10) Patent No.: US 7,681,582 B2
(45) Date of Patent: Mar. 23, 2010

(54) MULTIPLE SPRAY ARM DISHWASHING APPARATUS AND METHOD FOR ASSEMBLING SAME

(75) Inventors: Timothy Martin Wetzel, Louisville, KY (US); Joseph Duane Tobbe, Taylorsville, KY (US); Matthew David Mersch, Louisville, KY (US); Gregory Owen Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 811 days.

(21) Appl. No.: 11/236,396

(22) Filed: Sep. 27, 2005

(65) Prior Publication Data

US 2007/0068562 A1 Mar. 29, 2007

(51) Int. Cl.
*B08B 3/04* (2006.01)

(52) U.S. Cl. ..... 134/184; 134/198

(58) Field of Classification Search ..... 134/198, 134/94.1, 184
See application file for complete search history.

(56) References Cited

U.S. PATENT DOCUMENTS

| | | | | |
|---|---|---|---|---|
| 3,034,519 | A * | 5/1962 | Jacobs | 134/95.3 |
| 3,087,504 | A * | 4/1963 | Geschka | 134/57 D |
| 3,809,106 | A * | 5/1974 | Crabtree | 134/176 |
| 5,131,419 | A * | 7/1992 | Roberts | 134/50 |
| 5,291,626 | A * | 3/1994 | Molnar et al. | 8/158 |
| 5,560,060 | A * | 10/1996 | Dausch et al. | 8/158 |
| 5,564,968 | A * | 10/1996 | Werner | 451/67 |
| 5,752,533 | A * | 5/1998 | Edwards | 134/176 |
| 6,357,460 | B1 | 3/2002 | Bertsch et al. | |
| 6,431,188 | B1 | 8/2002 | Laszczewski, Jr. et al. | |
| 6,641,058 | B2 | 11/2003 | Hegeman et al. | |
| 7,032,604 | B2 * | 4/2006 | Welch | 134/135 |
| 7,331,356 | B2 | 2/2008 | VanderRoest et al. | |
| 7,445,013 | B2 | 11/2008 | VanderRoest et al. | |
| 7,462,017 | B2 * | 12/2008 | Marioni | 417/212 |
| 2006/0249181 | A1 | 11/2006 | Wetzel et al. | |
| 2008/0210274 | A1 | 9/2008 | VanderRoest et al. | |

FOREIGN PATENT DOCUMENTS

DE 31 16 217 * 11/1982

(Continued)

OTHER PUBLICATIONS

European Patent Office 0 119 517 Sep. 1984.*

(Continued)

*Primary Examiner*—Frankie L Stinson
(74) *Attorney, Agent, or Firm*—George L. Rideout, Esq.; Armstrong Teasdale LLP

(57) ABSTRACT

A dishwasher includes a cabinet, an upper rack and a lower rack disposed within the cabinet. The upper and lower racks support articles to be cleaned. The dishwasher also includes a first spray arm and a second spray arm rotatably mounted within the cabinet. The first and second spray arms are operated based on a wash cycle. A controller is operatively coupled to the first and second spray arms for controlling the wash cycle. The controller is configured to operate the first and second spray arms independently of one another, and the controller is configured to control the wash cycle based on a usage condition of the water being washed.

15 Claims, 4 Drawing Sheets

FOREIGN PATENT DOCUMENTS

| | | | |
|---|---|---|---|
| DE | 39 11 305 | * | 10/1989 |
| DE | 39 14 760 | * | 11/1990 |
| DE | 296 13 432 | * | 9/1996 |
| DE | 296 18 091 | * | 1/1997 |
| DE | 296 08 871 | * | 10/1997 |
| DE | 102 46 017 | * | 4/2004 |
| JP | 08-317892 | * | 12/1996 |
| JP | 10-080392 | * | 3/1998 |
| JP | 11-201078 | * | 7/1999 |

OTHER PUBLICATIONS

WIPO WO 01/60229 Aug. 2001.*

* cited by examiner

MULTIPLE SPRAY ARM DISHWASHING APPARATUS AND METHOD FOR ASSEMBLING SAME

BACKGROUND OF THE INVENTION

This invention relates generally to home appliances, and more particularly, to a multiple spray arm dishwashing apparatus.

Known dishwasher systems include a main pump assembly and a drain pump assembly for circulating and draining wash fluid within a wash chamber located in a cabinet housing. The main pump assembly feeds washing fluid to various spray arm assemblies for generating washing sprays or jets on dishwasher items loaded into one or more dishwasher racks disposed in the wash chamber. Fluid sprayed onto the dishwasher items is collected in a sump located in a lower portion of the wash chamber, and water entering the sump is filtered through one or more coarse filters to remove soil and sediment from the washing fluid.

At least some dishwashers include upper and/or mid level spray arms and lower spray arms. In operation, water is simultaneously supplied to both the upper and/or mid arms and to the lower arm, however, the upper and/or mid arm and lower arm are not operated separate from each other.

Reducing the energy consumption of home appliances, including residential dishwashers, is desirable. Considering that millions of dishwashers currently are employed in residential usage, even small energy savings can amount to a significant overall energy savings. Further, reducing the noise level of dishwashers also is desirable.

BRIEF DESCRIPTION OF THE INVENTION

In one aspect, a dishwasher is provided. The dishwasher includes a cabinet, an upper rack and a lower rack disposed within the cabinet. The upper and lower racks support articles to be cleaned. The dishwasher also includes a first spray arm and a second spray arm rotatably mounted within the cabinet. The first and second spray arms are operated based on a wash cycle. A controller is operatively coupled to the first and second spray arms for controlling the wash cycle. The controller is configured to operate the first and second spray arms independently of one another, and the controller is configured to control the wash cycle based on a usage condition of the water being washed.

In another aspect, a dishwasher is provided. The dishwasher includes a cabinet, an upper rack and a lower rack disposed within the cabinet. The upper and lower racks support articles to be cleaned. The dishwasher also includes an upper spray arm and a lower spray arm rotatably mounted within the cabinet. A first pump assembly is operatively coupled to the lower spray arm and a second pump assembly is operatively coupled to the upper spray arm. A drain pump is configured to drain water from the cabinet. A controller is operatively coupled to the first and second pump assemblies.

In still another aspect, a method for cleaning articles in a dishwasher having an upper rack and a lower rack is provided. The method includes providing a lower spray arm and an upper spray arm, operatively coupling a controller to the upper and lower spray arms, and configuring the controller to control the upper and lower spray arms based on a usage condition of water used in a wash cycle of the dishwasher.

DETAILED DESCRIPTION OF THE INVENTION

Figure 1:
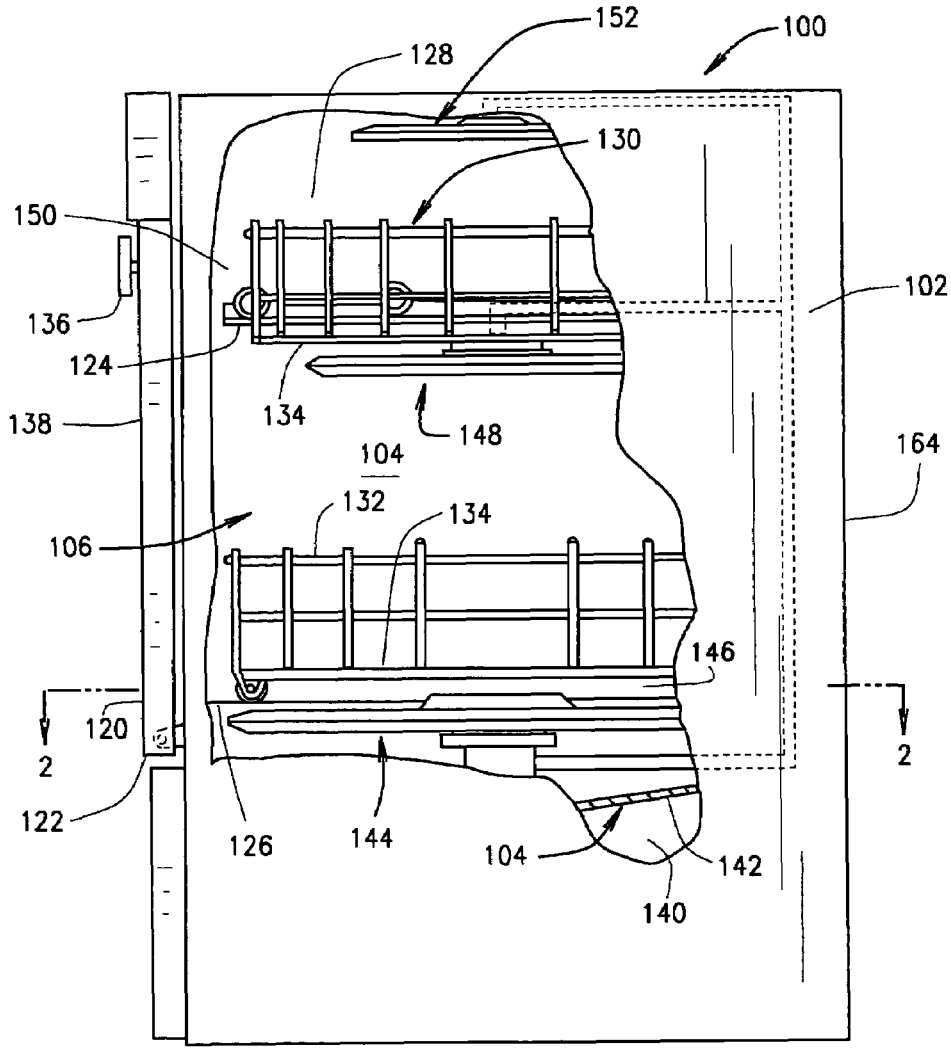
FIG. 1 a side elevation view of an example dishwasher system partially broken away.

FIG. 1 is a side elevation view of an example domestic dishwasher system 100 partially broken away. The flow control mechanism described herein may be practiced in other types of dishwashers and dishwasher systems other than just dishwasher system 100. Accordingly, the following description is for illustrative purposes only, and the flow control is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. In one embodiment, the fluid circulation assembly includes at least one washing water directing device, such as, for example, a spray arm. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region 150 of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly 152 is located above upper rack 130 at a sufficient height to accommodate a tallest item expected to be placed in upper rack 130, such as a glass (not shown) of a selected height.

Lower mid-level, and upper spray-arm assemblies 144, 148, 152 are fed by the fluid circulation assembly, and each spray-arm assembly 144, 148, 152 includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or upper spray arm 152 are also rotatably mounted and configured to generate a swirling spray pattern above and below upper rack 130 when the fluid circulation assembly is activated.

Figure 2:
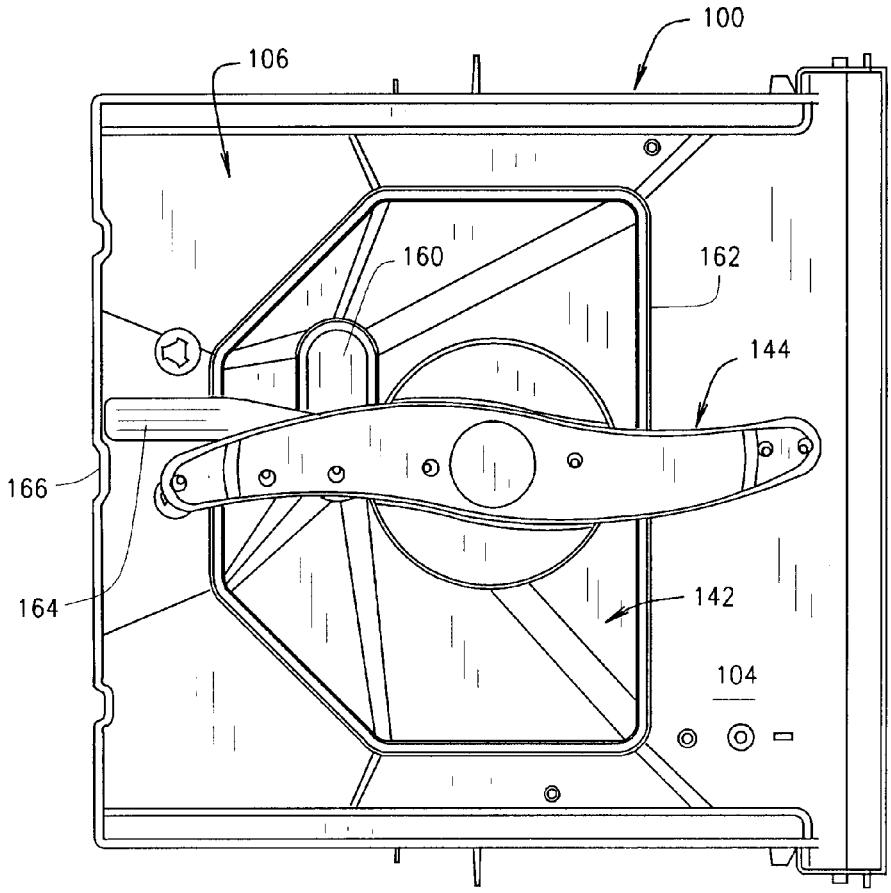
FIG. 2 is a top plan view of a portion of the dishwasher system shown in FIG. 1 along line 2-2.

FIG. 2 is a top plan view of a dishwasher system 100 just above lower spray arm assembly 144. Tub 104 is generally downwardly sloped beneath lower spray arm assembly 144 toward tub sump portion 142, and tub sump portion is generally downwardly sloped toward a sump 160 in flow communication with the fluid circulation assembly (not shown in FIG. 2). Tub sump portion 142 includes a six-sided outer perimeter 162. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 160 so that water sprayed from lower spray arm assembly 144, mid-level spray arm assembly 148 (shown in FIG. 1) and upper spray arm assembly 152 (shown in FIG. 1) is collected in tub sump portion 142 and directed toward sump 160 for filtering and re-circulation during a dishwasher system wash cycle. In addition, a conduit 164 extends beneath lower spray arm assembly 144 and is in flow communication with the fluid circulation assembly. Conduit 164 extends to a back wall 166 of wash chamber 106, and upward along back wall 166 for feeding wash fluid to mid-level spray arm assembly 148 and upper spray arm assembly 152.

Figure 3:
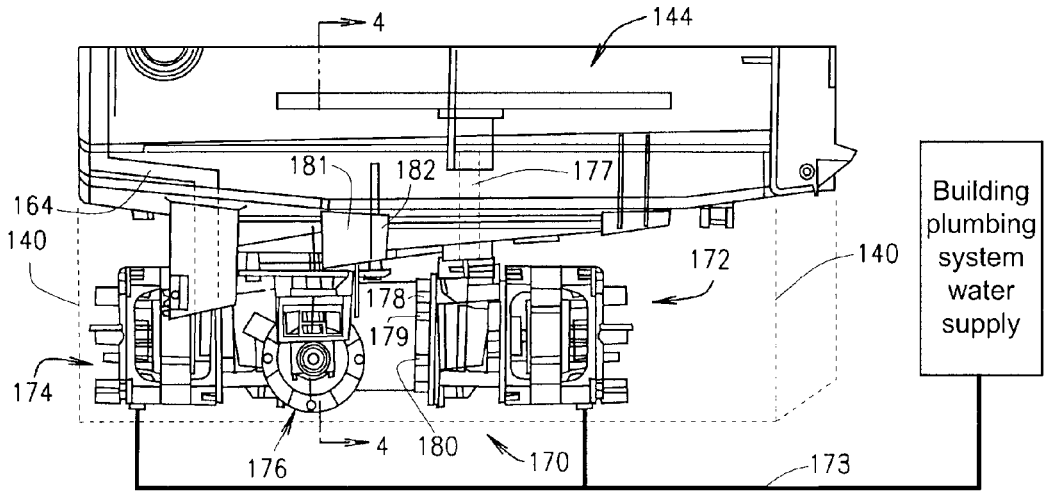
FIG. 3 is a partial side elevation view of the portion of the dishwasher system shown in FIG. 2.

FIG. 3 illustrates fluid circulation assembly 170 located below wash chamber 106 (shown in FIGS. 1 and 2) in machinery compartment 140 (shown in phantom in FIG. 3). Fluid circulation assembly 170 includes a first or main pump assembly 172 established in flow communication with a building plumbing system water supply pipe 173 and in flow communication with the sump 160. Fluid circulation assembly 170 also includes a second or secondary pump assembly 174 established in flow communication with a building plumbing system water supply pipe 173 and sump 160. Fluid circulation assembly 170 also includes a drain pump assembly 176 in fluid communication with sump 160 (shown in FIG. 2) and a building plumbing system drain pipe (not shown).

In an exemplary embodiment, first pump assembly 172 is in fluid communication with a lower spray arm conduit 177. Lower spray arm conduit 177 extends between first pump assembly 172 and lower spray arm assembly 144. As such, first pump assembly 172 supplies water from sump 160 and/or the building plumbing system water supply pipe to lower spray arm assembly 144. Additionally, lower spray arm assembly 144 is controlled by supplying water to lower spray arm assembly 144. As such, the operation of first pump assembly 172 controls the operation of lower spray arm assembly 144. First pump assembly 172 is coupled to control input selector 136 (shown in FIG. 1) and the operational state of first pump assembly 172 is controlled by control input selector 136.

Additionally, second pump assembly 174 is in fluid communication with conduit 164, also referred to hereinafter as upper spray arm conduit or mid-level spray arm conduit. Conduit 164 extends between second pump assembly 174 and upper and mid-level spray arm assemblies 152 and 148, respectively (shown in FIG. 1). As such, second pump assembly 174 supplies water from sump 160 and/or the building plumbing system water supply pipe to upper and mid-level spray arm assemblies 152 and 148. Additionally, upper and mid-level spray arm assemblies 152 and 148 are controlled by supplying water thereto. As such, the operation of second pump assembly 174 controls the operation of upper and mid-level spray arm assemblies 152 and 148. Second pump assembly 174 is coupled to control input selector 136 and the operational state of second pump assembly 174 is controlled by control input selector 136.

In one embodiment, first pump assembly 174 is also in fluid communication with conduit 164 such that first pump assembly 174 may operate mid-level and upper spray arm assemblies 148 and 152.

Dishwasher system 100 includes a temperature sensor 178 received within tub sump portion 142. In one embodiment, temperature sensor 178 is received within sump 160 or communicates with the water within sump 160. As such, temperature sensor 178 is configured to determine a usage condition of the water used in the washing cycle, namely the temperature. Temperature sensor 178 is coupled to control input selector 136 (shown in FIG. 1) such that dishwasher system 100 controls the operational state of first and second pump assemblies 172 and 174 based on a signal from temperature sensor 178 relating to the temperature usage condition of the water. For example, when the temperature of the water is determined to be at a predetermined temperature, control input selector 136 may change the mode of operation of first and/or second pump assemblies 172 and/or 174. Additionally, the mode of operation of first and/or second pump assemblies 172 and/or 174 may be continuously adjusted or adapted to the usage condition of the water.

Dishwasher system 100 includes a turbidity sensor 179 received within tub sump portion 142. In one embodiment, turbidity sensor 179 is received within sump 160 or communicates with the water within sump 160. As such, turbidity sensor 179 is configured to determine a usage condition of the water used in the washing cycle, namely the cleanliness or soil level of the water. For example, the turbidity sensor 179 may determine an amount of particulates in the water. Turbidity sensor 179 is coupled to control input selector 136 (shown in FIG. 1) such that dishwasher system 100 controls the operational state of first and second pump assemblies 172 and 174 based on a signal from turbidity sensor 179 relating to the turbidity usage condition of the water. For example, when the amount of particulates in the water is determined to be below a predetermined amount, control input selector 136 may change the mode of operation of first and/or second pump assemblies 172 and/or 174. Additionally, the mode of operation of first and/or second pump assemblies 172 and/or 174 may be continuously adjusted or adapted to the usage condition of the water. As such, a flexible system is provided.

In one embodiment, dishwasher system 100 includes a pump operating sensor 180 coupled to first and second pump assemblies 172 and 174. pump operating sensor is configured to determine an operating condition of the pump. In one embodiment, sensor 180 is a pressure sensor configured to determine a pressure of the water entering or exiting pump assembly 172 or 174. In another embodiment, sensor 180 is a current sensor configured to measure the operating current of pump assembly 172 or 174. Sensor 180 is coupled to control input selector 136 such that dishwasher system 100 controls the operational state of first and second pump assemblies 172 and 174 based on a signal from pump operating sensor 180 relating to the operating condition of pump assemblies 172 or 174.

In one embodiment, dishwasher system 100 includes a heater 181 for increasing the temperature of the water supplied to spray arm assemblies 144, 148, 152. Dishwasher system 100 also includes a fan 182 for ventilating cabinet 102 during a drying portion of the cycle. Heater 181 and fan 182 are coupled to and operated by control input selector 136.

Figure 4:
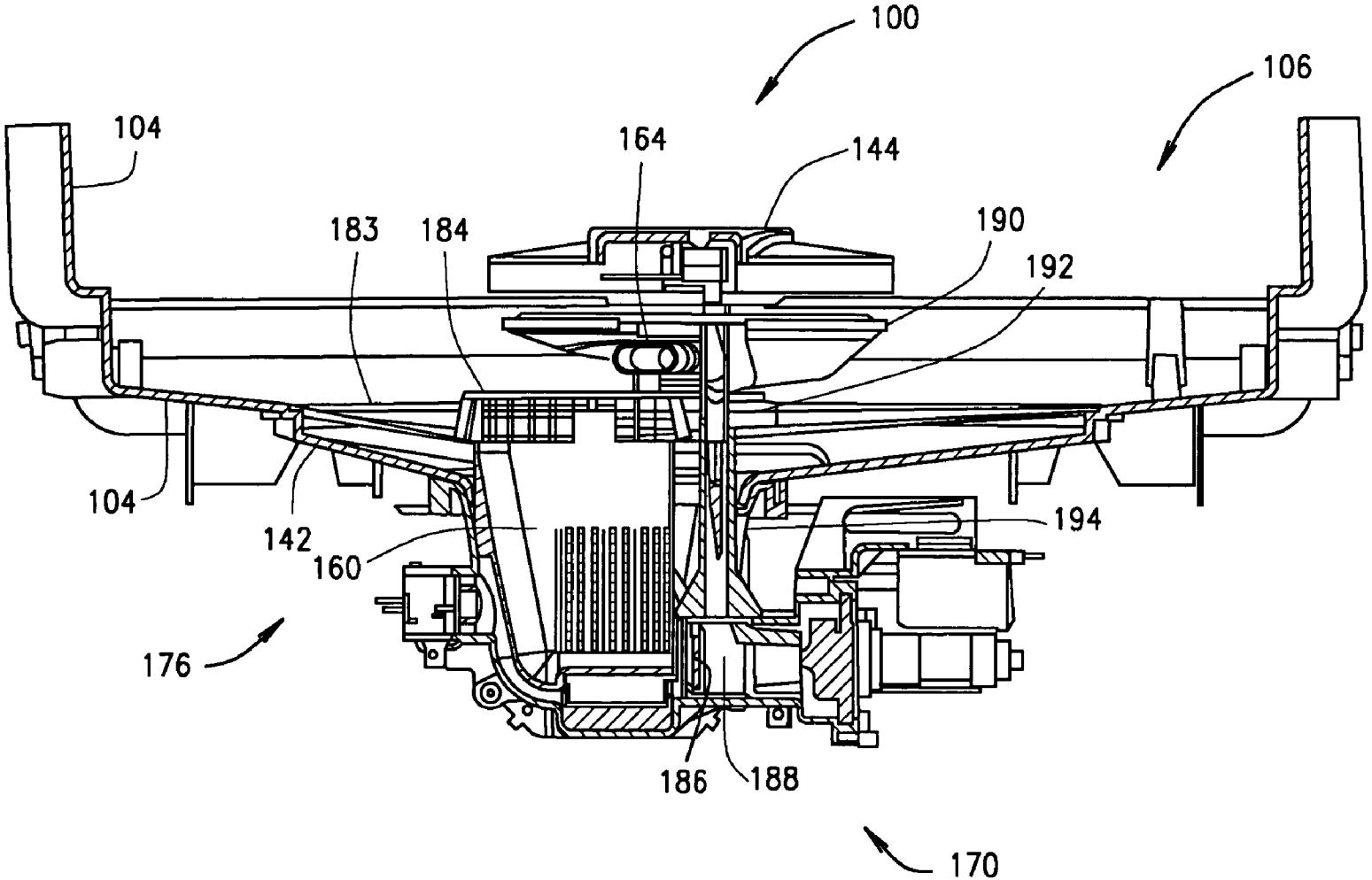
FIG. 4 is a cross sectional schematic view of the portion of the dishwasher system shown in FIG. 3 along line 4-4.

FIG. 4 is a cross sectional schematic view of dishwasher system 100, and more specifically of fluid circulating assembly 170 through drain pump assembly 174. Tub 104 is downwardly sloped toward tub sump portion 142, and tub sump portion is downwardly sloped toward sump 160. As wash fluid is pumped through lower spray arm assembly 144, and further delivered to mid-level spray arm assembly 148 (shown in FIG. 1) and upper spray arm assembly 152, washing sprays are generated in wash chamber 106, and wash fluid collects in sump 160.

Sump 160 includes a cover 183 to prevent larger objects from entering sump 160, such as a piece of silverware or another dishwasher item that is dropped beneath lower rack 132 (shown in FIG. 1). A course filter 184 is located to filter wash fluid from sediment and particles of a predetermined size before flowing into sump 160 over tub sump portion 142. Wash fluid flowing through cover 183 flows through coarse filter 184 into sump 160.

A drain check valve 186 is established in flow communication with sump 160 and opens or closes flow communication between sump 160 and a drain pump inlet 188. Drain pump assembly 176 is in flow communication with drain pump inlet 188 and includes an electric motor for pumping fluid at inlet 188 to a pump discharge (not shown in FIG. 4) and ultimately to a building plumbing system drain (not shown). When drain pump assembly 176 is energized, a negative pressure is created in drain pump inlet 188 and drain check valve 186 is opened, allowing fluid in sump 160 to flow into fluid pump inlet 188 and be discharged from fluid circulation assembly 170.

A fine filter assembly 190 is located below lower spray arm assembly and above tub sump portion 142. As wash fluid is pumped into lower spray arm 144 to generate a washing spray in wash chamber 106, wash fluid is also pumped into fine filter assembly 190 to filter wash fluid sediment and particles of a smaller size than coarse filters 184 and 185. Sediment and particles incapable of passing through fine filter assembly 190 are collected in fine filter assembly 190 and placed in flow communication with a fine filter drain tube 192 received in a fine filter drain docking member 194, which is, in turn, in flow communication with drain pump inlet 188. Thus, when pressure in fine filter assembly 190 exceeds a predetermined threshold, thereby indicating that fine filter assembly is clogged with sediment, drain pump assembly 176 can be activated to drain fine filter assembly. Down jets (not shown) of lower spray arm assembly 144 spray fluid onto fine filter assembly 190 to clean fine filter assembly 190 during purging or draining of fine filter assembly 190.

Figure 5:
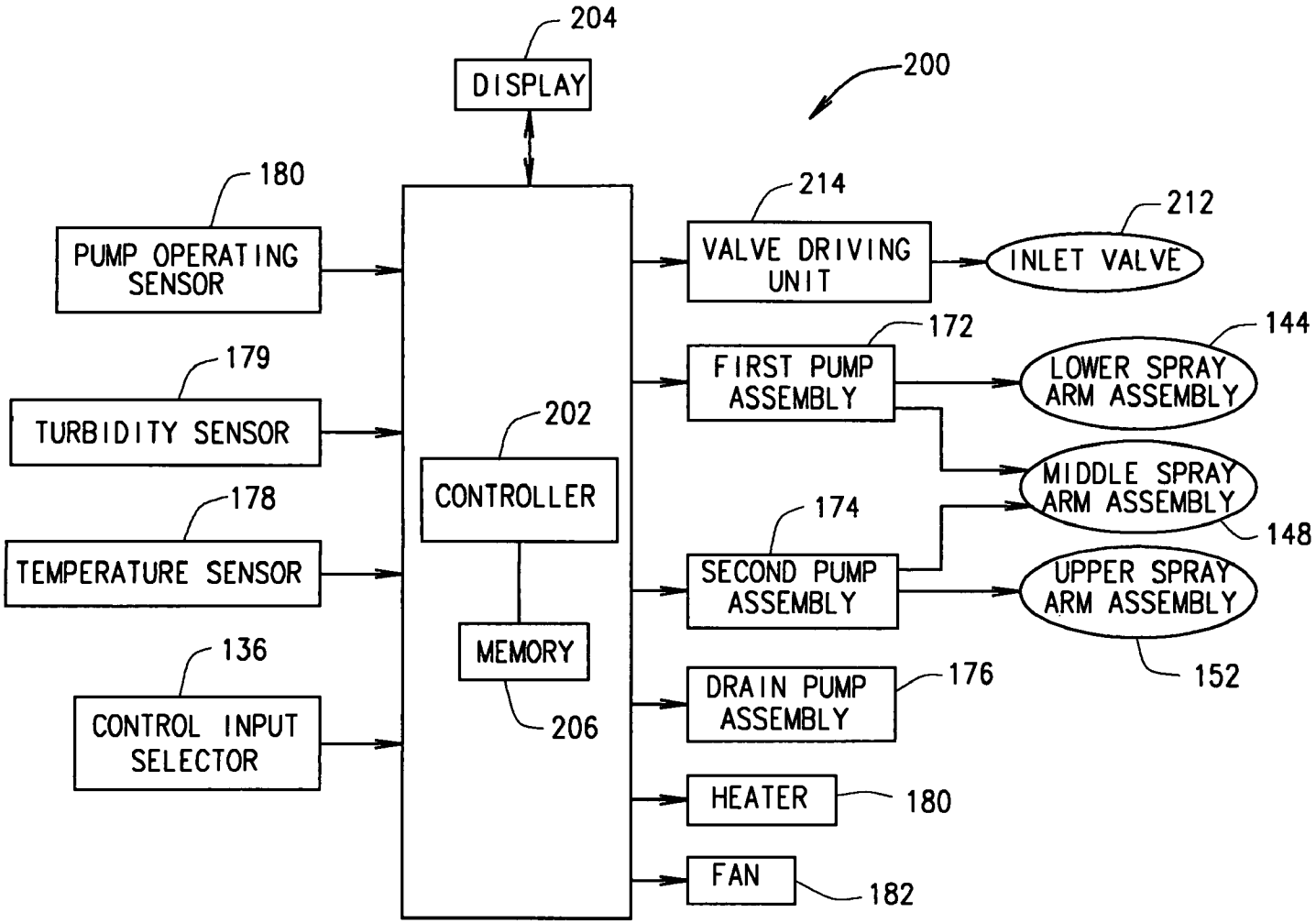
FIG. 5 is a schematic view of an exemplary control system for use with the dishwasher shown in FIG. 1.

FIG. 5 is a schematic view of an exemplary control system 200 for use with dishwasher system 100 shown in FIG. 1. Control system 200 comprises a controller 202 such as, but not limited to, an integrated circuit such as a microprocessor, a computers, a processor, a microcontroller, a microcomputer, a programmable logic controller, an application specific integrated circuit, and other programmable logic circuits.

Controller 202 is operatively coupled to control input selector 136. An operator may enter instructions or select desired wash cycles and features via control input selector 136. In one embodiment a display or indicator 204 is coupled to controller 202 to display appropriate messages and/or indicators, such as a timer, and other known items of interest to the user. A memory 206 is coupled to controller 202 and stores instructions, calibration constants, and other information relating to a usage history and used to complete a selected wash cycle. Memory 206 may, for example, be a random access memory (RAM). In alternative embodiments, other forms of memory could be used in conjunction with RAM memory, including but not limited to electronically erasable programmable read only memory (EEPROM).

In the exemplary embodiment, controller 202 is operatively coupled to temperature sensor 178, turbidity sensor 179, pump operating sensor 180, an inlet valve 212 via a valve driving unit 214, display 204, first pump assembly 172, second pump assembly 174, drain pump assembly 176, heater 181, and fan 182. Controller 202 is programmed to control the operation of the above mentioned components which will be further explained in more detail hereinafter.

In the exemplary embodiment, temperature sensor 178 provides a signal to controller 202 that is representative of a temperature of water within tub 104 and/or tub sump portion 142. Turbidity sensor 179 provides a signal to controller 202 representative of a turbidity of the water within tub 104 and/or tub sump portion 142. As such, controller 202 can command a corresponding component, such as the pumps, to execute a specific function based on a signal from temperature sensor 178 or turbidity sensor 179.

In an exemplary embodiment, first pump assembly 172 is configured to supply water to lower spray arm 144 and, second pump assembly 174 is configured to supply water to mid-level spray arm 148 and upper spray arm 152. Alternatively, first pump assembly 172 is configured to supply water to mid-level spray arm 148 rather than, or in addition to, second pump assembly 174. Controller 202 operates pumps 172 and 174, and thus, spray arms 144, 148, 152 depending on practical needs during the process of a wash cycle. As such, controller 202 can operate mid-level and upper spray arms 148, 152 independently of lower spray arm 144 based on inputs to controller 202 relating to a cycle progression such as a signal from temperature sensor 178 or a signal from turbidity sensor 179, inputs by a user such as a cycle selection, and or inputs to memory 206, such as inputs relating to a usage history. Alternatively, controller 202 can operate upper spray arm 152 independently of mid-level and upper spray arms 144, 148.

In operation, door 120 is opened and soiled dishes are loaded on either upper rack 130, lower rack 132, or both racks 130 and 132, as the user desires. Then, door 120 is closed. Next, dishwasher system 100 is initiated by pressing a start button on control input selector 136, and water is then introduced into cabinet 102 and sump 160 by controller 202 activating inlet valve 212 through valve driving unit 214. When the water reaches a predetermined amount or level, dishwasher system 100 starts a wash process.

In the exemplary embodiment, the user can select a first mode wherein mid-level and/or upper spray arm assemblies 148 and 152 are activated to spray water to upper rack 130 such that only upper rack 130 is washed. In this example, only second pump assembly 174 is activated. The user can also select a second mode wherein lower spray arm assembly 144 is activated and only lower rack 132 is washed. In this example, only first pump assembly 172 is activated. In another embodiment, the user selects a third mode wherein both upper rack 130 and lower rack 132 are washed by all of spray arm assemblies 144, 148, 152. In this example, first and second pump assemblies 172 and 174 are activated by controller 202.

During a wash cycle, the usage condition of the water is monitored by temperature sensor 178 and turbidity sensor 179. When temperature sensor 178 determines that the temperature of the water is at a predetermined temperature, pump assemblies 172 and/or 174 may be activated or de-activated by controller 202. When turbidity sensor 179 senses that the turbidity of water within sump 160 reaches a predetermined level, a signal from turbidity sensor 179 is sent to controller 202. In one embodiment, drain pump assembly 176 is activated by controller 202 to discharge the undesired water outside dishwasher system 100. In another embodiment, pump assemblies 172 and/or 174 may be activated or de-activated by controller 202. In the exemplary embodiment, a detergent is added into the water in the wash cycles. To obtain a better cleaning result, heater 181 is actuated by controller 202 during the process of the wash cycle to provide heat to the water. As such, the heated water facilitates eliminating substances adhering to the items being washed.

During the process, controller 202 is configured to continuously diagnose the washing cycle, and can change the mode of operation based on inputs and variables to controller 202. Controller 202 operates pump assemblies 172, 174, 176 based on the cycle selection by the user. Additionally, controller 202 operates pump assemblies 172, 174, 176 based on the usage history stored in memory 206. Moreover, controller 202 continuously adjusts the operation of pump assemblies 172, 174, 176 based on the signals from temperature sensor 178 or a signal from turbidity sensor 179. For example, when temperature sensor 178 senses that the temperature of water in sump 160 is overheated, controller 202 commands pump assemblies 172 and 174 to supply more water to cabinet 102. When turbidity sensor 179 senses that the turbidity of water reaches a predetermined clean level, a corresponding feedback will be signaled to controller 202. Then, controller 202 may de-activate one of pump assemblies 172 and 174. As a result, at least some of spray arm assemblies 144, 148, 152 are also de-activated. As such, energy usage of dishwasher system 100 is reduced and noise produced during the wash cycle is also reduced.

By operating the spray arm assemblies independently of one another, dishwasher system operates in a cost effective and reliable manner. Moreover, by providing an additional pump for controlling the spray arm assemblies independently, the dishwasher system operates efficiently, effectively, and quickly. Furthermore, by operating the pump assemblies based on the usage condition of the water, such as the temperature and turbidity of the water, the operating condition of the components of the dishwasher system, the cycle selection, and the usage history, the dishwasher system operates in a cost effective and reliable manner. For example, the dishwasher system is flexible and can adapt to the particular load of items to be washed, as opposed to a time based system wherein the system would operate each cycle for a predetermined time. As a result, the items may be more effectively cleaned and the system may operate in a more efficient manner.

While the invention has been described in terms of various specific embodiments, those skilled in the art will recognize that the invention can be practiced with modification within the spirit and scope of the claims.

What is claimed is:

1. A dishwasher comprising:

a cabinet;

a sump positioned within said cabinet and configured to collect water;

an upper rack and a lower rack disposed within said cabinet, said upper and lower racks configured to support articles to be cleaned;

an upper spray arm, a lower spray arm, and a third spray arm rotatably mounted within said cabinet;

a first pump assembly operatively coupled to said lower spray arm and a second pump assembly operatively coupled to said upper spray arm, one of said first and second pump assemblies operatively coupled to said third spray arm, said first pump assembly coupled to a water supply system and to said sump, said first pump assembly configured to deliver water from the water supply system and from said sump, said second pump assembly coupled to the water supply system and to said sump, said second pump assembly configured to deliver water from the water supply system and from said sump;

a drain pump configured to drain water from said cabinet; and a controller operatively coupled to said first and second pump assemblies.

2. A dishwasher in accordance with claim 1 wherein said controller configured to control said first and second pump assemblies based on a usage condition of the water being washed.

3. A dishwasher in accordance with claim 2 further comprising a turbidity sensor coupled to said controller, said turbidity sensor providing a signal relating to a usage condition of the water being washed to said controller representative of a turbidity of water within said dishwasher.

4. A dishwasher in accordance with claim 2 further comprising a temperature sensor coupled to said controller, said temperature sensor providing a signal relating to the usage condition of the water being washed to said controller that is representative of a temperature of water within said dishwasher.

5. A dishwasher in accordance with claim 1 further comprising a control panel operatively coupled to said controller, said control panel configured to receive inputs from a user relating to a cycle selection, the cycle selection includes an upper rack only wash mode, a lower rack only wash mode, and a dual rack wash mode, wherein said controller operates said first and second pump assemblies based on the cycle selection, and wherein said controller is configured to change the mode of operation from the cycle selection selected by the user based on a usage condition of the water being washed.

6. A dishwasher in accordance with claim 1 wherein said third spray arm is located between said upper spray arm and said lower spray arm.

7. A dishwasher in accordance with claim 1 wherein said controller configured to adjust the operation of said first and second pump assemblies based on an operation condition of said dishwasher.

8. A dishwasher in accordance with claim 7 further comprising a pressure sensor coupled to said controller, said pressure sensor providing a signal relating to an operation condition of said dishwasher to said controller representative of a water pressure within said dishwasher.

9. A dishwasher comprising:

a cabinet;

a sump positioned within said cabinet and configured to collect water;

an upper rack and a lower rack disposed within said cabinet, said upper and lower racks configured to support articles to be cleaned;

a first spray arm, a second spray arm, and a third spray arm rotatably mounted within said cabinet, said first, second, and third spray arms operating based on a wash cycle;

a first pump coupled to a water supply pipe and to said sump, said first pump configured to supply water to said first spray arm from the water supply pipe and from said sump;

a second pump coupled to the water supply pipe and to said sump, said second pump configured to supply water to said second spray arm and said third spray arm from the water supply pipe and from said sump; and a controller operatively coupled to said first and second spray arms for controlling the wash cycle, said controller configured to operate said first and second spray arms independently of one another, said controller configured to control the wash cycle based on a usage condition of the water being washed.

10. A dishwasher in accordance with claim 9 further comprising a turbidity sensor coupled to said controller, said turbidity sensor providing a signal relating to the usage condition of the water being washed to said controller representative of a turbidity of water within said dishwasher.

11. A dishwasher in accordance with claim 9 further comprising a temperature sensor coupled to said controller, said temperature sensor providing a signal relating to the usage condition of the water being washed to said controller that is representative of a temperature of water within said dishwasher.

12. A dishwasher in accordance with claim 9 further comprising a turbidity sensor and a temperature sensor, wherein said controller operates said first and second spray arms based on at least one of a signal from said turbidity sensor and a signal from said temperature sensor.

13. A dishwasher in accordance with claim 9 wherein said controller is operatively coupled to said third spray arm and configured to operate said third spray arm independently of said first and second spray arms.

14. A dishwasher in accordance with claim 9 further comprising a drain pump configured to drain the water from said cabinet.

15. A dishwasher in accordance with claim 9 wherein said third spray arm is located between said first and second spray arms.

* * * * *